US006549121B2

(12) United States Patent
Povey et al.

(10) Patent No.: US 6,549,121 B2
(45) Date of Patent: Apr. 15, 2003

(54) ILLUMINATED EMERGENCY SIGNALING DEVICE

(76) Inventors: Philip Francis Povey, 25362 Via Breve, Mission Viejo, CA (US) 92691; Christopher Allen Westlake, 62 Raven, Aliso Viejo, CA (US) 92656

( * ) Notice: Subject to any disclaimer, the term of this patent is extended or adjusted under 35 U.S.C. 154(b) by 0 days.

(21) Appl. No.: 10/050,194

(22) Filed: Jan. 16, 2002

(65) Prior Publication Data

US 2003/0025607 A1 Feb. 6, 2003

Related U.S. Application Data

(63) Continuation-in-part of application No. 29/145,919, filed on Jul. 31, 2001, now Pat. No. Des. 457,457.

(51) Int. Cl.[7] ..... G08B 5/00

(52) U.S. Cl. ..... 340/322; 340/908; 340/908.1; 340/321

(58) Field of Search ..... 340/908, 908.1, 340/321, 473, 691.6, 691.3, 693.2, 322; 116/202; 40/586

(56) References Cited

U.S. PATENT DOCUMENTS 6,150,957 A * 11/2000 Henz et al. ..... 340/908

* cited by examiner

*Primary Examiner*—Daryl Pope
(74) *Attorney, Agent, or Firm*—Stetina Brunda Garred & Brucker

(57) ABSTRACT

A battery-powered emergency signaling device including a housing which encloses a battery pack disposed for providing power to the device. The housing includes a base plate for support of the device and has a cover attached to the base plate for sealing up the device. At least one light emitting diode ("LED") pulsed by an electronic circuit, which LED is powered by a battery within the battery pack. A race is disposed substantially about the periphery of the cover for reflecting light received from the LED. The race is formed as an integral part of the cover, which is made of clear acrylic plastic. The cover includes support members disposed between the base plate and the cover for providing strength to the device.

16 Claims, 2 Drawing Sheets

ILLUMINATED EMERGENCY SIGNALING DEVICE

CROSS-REFERENCE TO RELATED APPLICATIONS

This is a Continuation-in-Part of Application Ser. No. 29/145,919, filed Jul. 31, 2001, now U.S. Pat. No. D,457,457 by the same inventor hereof.

STATEMENT RE: FEDERALLY SPONSORED RESEARCH/DEVELOPMENT (Not Applicable)

BACKGROUND OF THE INVENTION

The present invention relates to the field of emergency signal lighting and in particular to an improved, light weight, self-contained emergency flashing beacon.

In the event of vehicular, aircraft or recreational boating accident or other emergency situation, emergency vehicles and personnel must respond to situations where it is difficult to locate the actual scene of the accident or emergency. Further, there is frequently no means available at an emergency site to ward off unwary passers-by from falling prey to possible dangers existing at the emergency site.

Markings or other representations for identifying an emergency site are seldom lit or are not easily visible. As a result, emergency personnel or vehicles can easily miss a geographic marking of a building from the street. Should the emergency arise in a desolate location, such marking may be entirely missing and emergency personnel may have further difficulties in locating the site of the emergency.

Advancements in communication and technology has improved the ability to respond to emergency situations. Systems have been set up for improving response times to emergencies so that emergency personnel, such as paramedics, the police, and the fire department can quickly respond to the particular emergency. In particular, with the recent widespread use of the 9-1-1 emergency telephone system, emergency personnel are provided with the capability to quickly respond to an emergency. Moreover, medical technology has advanced to the point where human health from various traumas can be minimized and lives can now be saved in situations where it was unlikely to do so before.

However, life or death is often measured during those critical moments when emergency personnel are searching for the actual location of the emergency. Of course, once the first emergency vehicle is parked at the location, it serves as a beacon for those following by using some type of rotating light radiating brilliant flashes. Also, the emergency vehicle serves as a warning to passers-by to proceed cautiously. Nevertheless, prior to the emergency personnel reaching the site of the emergency, there is often no means to direct personnel to the site of the emergency or to provide a warning of the emergency itself. Should the personnel responding to the emergency be sufficiently delayed, personal property or human life can be lost regardless of the advances made in medicine and emergency response systems.

For many years, combustible signal flares have been used as emergency signals when a vehicle is in distress or when an accident has occurred at night. Such flares are a fire hazzard, not to mention a hazzard to the individuals using them. Once a flare has been ignited, it is not safe for an individual to move or relocate it. The individual could burn their clothes, or their skin, or injure others. Moreover, combustible flares could ignite spilt fuel or dry brush along the roadside.

A more recent example of a prior emergency signaling device is disclosed in U.S. Pat. No. 5,797,672, entitled SAFETY LIGHT. This device was designed primarily as a temporary replacement for an automobile's tail light, but it has a secondary use as an emergency road signal beacon. The device employs an array of Light Emitting Diodes (LED's) in lieu of an incandescent light in order to provide durability, increase power life and consume less power, thereby permitting operation for a long period of time even though powered by a battery. In contrast, the emergency signaling device of the present invention is more efficient in design and preferably only requires one or more LED's.

Another example of a prior art device is disclosed in U.S. Pat. No. 5,831,522, entitled PORTABLE VISUAL EMERGENCY SIGNAL DEVICE. This prior art device is a triangle shaped light typically used as an emergency road signal or direction beacon. The device of the present invention is smaller and more compact in size, thereby it is more efficient than this prior art device.

Accordingly, there remains a need for a visual signal device that will operate to not only aid emergency personnel to locate an emergency site, but to provide a warning of an emergency condition. Further, due to the fact that emergencies can occur in the home, at work or on vacation, there is always a need for having an emergency signal device on hand so that help can be summoned wherever it is needed. Moreover, it is desirable that the signal device be durable, environmentally safe, available at a reasonable cost and compact in size and operate to unequivocally signal an emergency condition so that lives and property may be protected. The present invention fulfils all these needs.

BRIEF SUMMARY OF THE INVENTION

An object of the present invention is to provide an emergency signaling device that is simple in construction yet durable and safe to use.

Another object of the present invention is to provide an emergency signaling device that is reliable, and is shock resistant as well as water resistant.

Still another object of the present invention is to provide an emergency signaling device that is versatile to use.

A feature of the present invention is the use of light emitting diodes pulsed at a constant rate for producing an emergency signal beacon.

Another feature of the present invention is the use of plastic components that emit light at imperfections in the plastic when light is transmitted along the length thereof, thereby making it possible to provide a light glow completely around the circumference of the device.

These and other objects, which will become apparent as the invention is described in detail below, are provided by a battery-powered emergency signaling device including a housing which encloses a battery pack disposed for providing power to the device. The housing includes a base plate for support of the device and has a cover attached to the base plate for providing a durable impact resistant shell as well as moisture resistant barrier. At least one light emitting diode ("LED") is pulsed by an electronic circuit, which is powered by the battery. A race is disposed substantially about the periphery of the cover for reflecting light received from the LED.

According to one embodiment of the present invention, the race is formed as an integral part of the cover, which is preferably made of high impact strength polymer such as a clear acrylic plastic material.

In another embodiment of the present invention, the cover includes support members disposed between the base plate and the cover for providing strength to the device.

Still other objects and features of the present invention will become readily apparent to those skilled in the art from the following detailed description, wherein is shown and described only the preferred embodiment of the invention, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive, and what is intended to be protected by Letters Patent is set forth in the appended claims.

BRIEF DESCRIPTION OF THE DRAWINGS

The general purpose of this invention, as well as a preferred mode of use, its objects and advantages will best be understood by reference to the following detailed description of an illustrative embodiment with reference to the accompanying drawings in which like reference numerals designate like parts throughout the figures thereof, wherein.

DETAILED DESCRIPTION OF THE INVENTION

Figure 1:
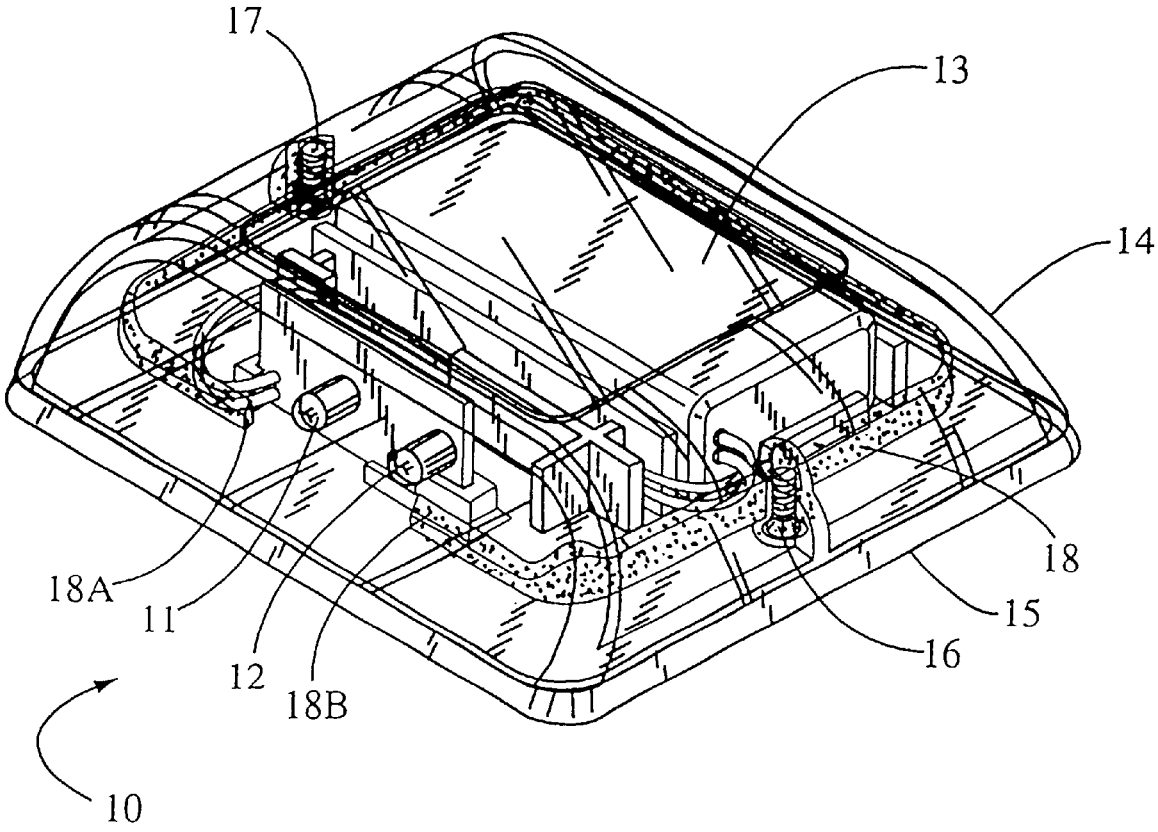
FIG. 1 is a perspective view of the emergency signaling device according to the present invention.

Referring now to the drawings and FIG. 1 in particular, a perspective view of the emergency signaling device 10 of the Present invention is shown. Preferably a pair of LED's 11 and 12 are strobed by an electronic circuit, not shown. Such a circuit is well known in the art and will not be amplified further herein. The electronic circuit is powered by batteries within a battery pack 13. The device 10 is covered by a clear acrylic plastic cover 14 secured to a base plate 15 by a pair of screws 16 and 17. The cover 14 has formed therein a race 18 for conducting light emitted by the LED's, as will be shown below. Ends 18A and 18B of the race 18 define a window for transmission of light emitted from the LED's. Also, the ends 18A and 18B receive light from the LED's for transmission through the race 18 as explained below.

The device 10 makes use of the principle of light reflection, similar to the way light is reflected/transmitted in a fiber optical strand. Imperfections in the plastic race 18 within the device 10, act like tiny mirrors along the plastic race. These tiny mirrors create a multiplicity of reflections, just like the reflection on the inside of a fiber optic cable. One can experience this sort of reflection with a flashlight and a sheet of glass in a dark room. If the flashlight as directed through he glass sheet at a 90 degree angle, it passes straight through the glass. However, if the flashlight is directed at the edge of the glass, the glass will act as a conductor of light. Light travels through the plastic in a similar manner, and is reflected at imperfections (i.e., tiny mirrors) in the plastic race 18. Hence, light from the LED's 11 and 12 is emitted about the circumference of the device 10.

Figure 2:
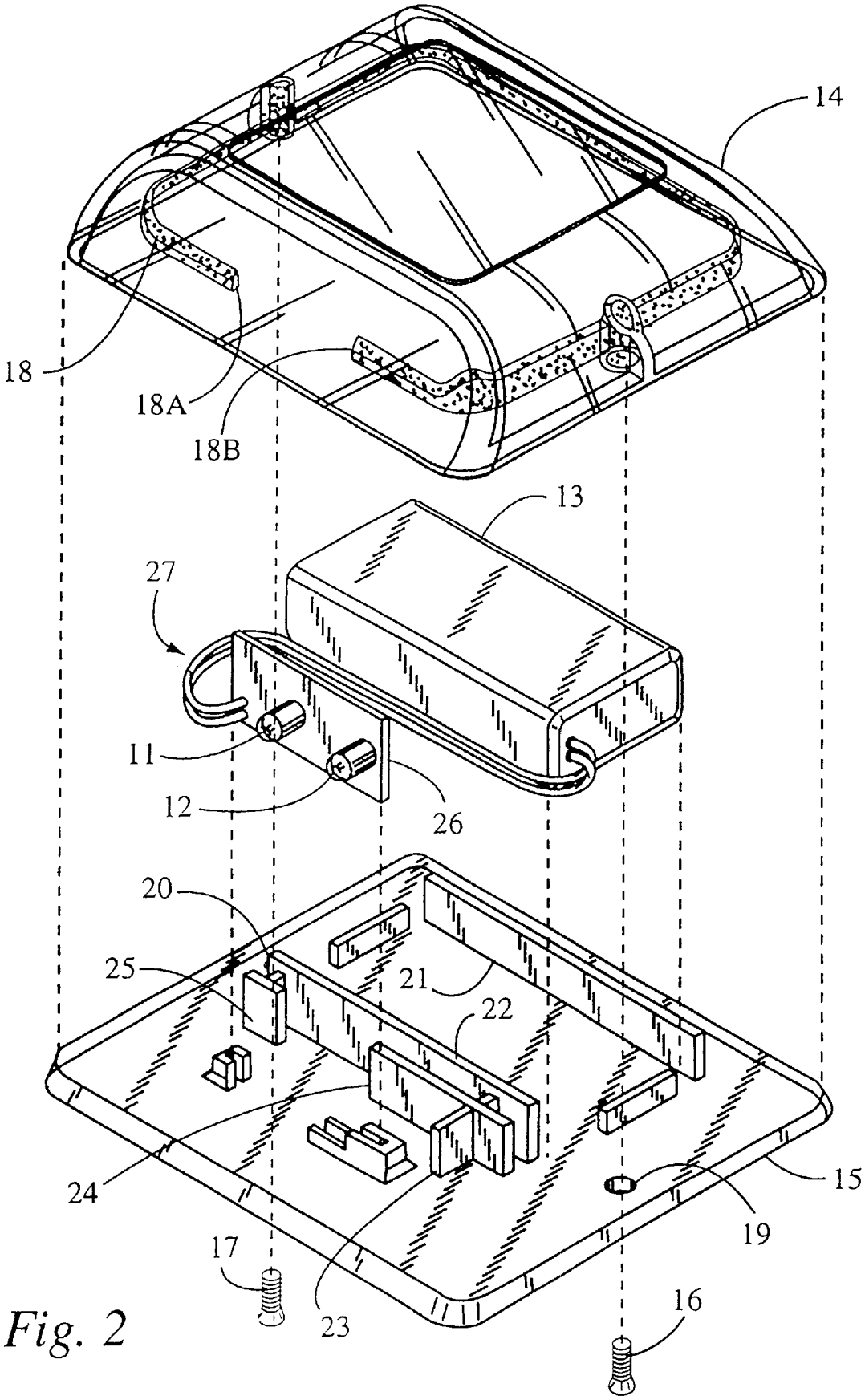
FIG. 2 is an exploded view of the emergency signaling device according to the present invention.

Referring now to FIG. 2, an exploded view of the device 10 of the present invention is shown. The base plate 15 provides support for the device, and when sealed it provides water-tight integrity of the finished device. Openings 19 and 20 are formed in the base plate 15 for receiving the screws 16 and 17, respectively, which secure the base plate 15 to the cover 14. Between the base plate 15 and the cover 14 are located a plurality of vertical braces 21 through 25, which help support the cover 14 when under stress. For example, the device 10 may be placed on the pavement in the vicinity of an accident where it is most likely that a vehicle will run over it, or someone might step on it. Hence, it is prudent to reinforce the device against such eventualities.

According to the disclosed embodiment, the pair of LED's 11 and 12 are disposed on a PC board 26 and are located within the window in the race 18 defined between the ends 18A and 18B of the race 18. It is understood that one could employ only one LED without departing from the scope of the invention hereof. Circuitry (not shown) controlling the LED's 11 and 12 is located on the side of the PC board 26 opposite from the LED's. The batteries contained within the battery pack 13 provide a source of direct current for the LED's 11 and 12 (as well as for the circuitry) by means of wires 27. In accordance with one embodiment, the battery pack 13 includes a pair of AA batteries. Other suitable voltage sources may be used without departing from the scope of the present invention.

Although the invention has been described with reference to a specific embodiment, this description is not meant to be construed in a limiting sense. Various modifications of the disclosed embodiment as well as alternative embodiments of the invention will become apparent to one skilled in the art upon reference to the description to the invention. It is therefore contemplated that the appended claims will cover any modifications of the embodiments that fall within the true scope of the invention.

What is claimed is:

1. An emergency signaling device comprising:

a. a housing for enclosing and sealing said device;

b. pulsating light means within said housing and powered by a battery also within said housing; and, c. a discontinuity on the housing capable of coupling light received from said pulsating light means around the periphery of said device, whereby light is reflected through the discontinuity and emitted therefrom.

2. The device as in claim 1 wherein said housing is made of acrylic plastic.

3. the device as in claim 1 wherein said housing comprises a base plate and a cover and includes support members disposed between said base plate and said cover for adding strength to said device.

4. The device as in claim 1 wherein said pulsating light means comprises at least one light emitting diode.

5. The device as in claim 1 wherein the discontinuity comprises a clear acrylic race running substantially about the periphery of said device housing.

6. The device as in claim 5 wherein said device is constructed of clear acrylic plastic.

7. The device as in claim 5 wherein said race is formed as an integral part of said cover, which is made of clear acrylic plastic.

8. The device as in claim 5 wherein said light emitting diodes are strobed when pulsed by an electronic circuit powered by said battery.

9. The device as in claim 5 further including support members disposed between said base plate and said cover for providing strength to said device.

10. A battery-powered emergency signaling device comprising:

a. a housing having an interior battery pack disposed for receiving a battery, wherein said housing includes a base plate for support of said device;

b. a cover for said device attached to said base plate for sealing of said device;

c. at least one light emitting diode pulsed by an electronic circuit powered by said battery;

d. a race disposed substantially about the periphery of said cover for reflecting light received from said at least one light emitting diode through the race.

11. A battery-powered emergency signaling device comprising:

a. a strobed light source means disposed on at least one side of said device; and, b. a discontinuity optically coupled to said strobed light source means, said discontinuity disposed about the circumference of said device, wherein the discontinuity is capable of reflecting light therethrough and emitting light therefrom in multiple directions.

12. The device as in claim 11 wherein said device is constructed of clear acrylic plastic.

13. The device as in claim 11 wherein said discontinuity is formed of clear acrylic plastic.

14. The device as in claim 11 wherein said light source means comprises a pair of light emitting diodes strobed when pulsed by an electronic circuit powered by said battery.

15. The device as in claim 11 further including support members disposed within said device for providing strength thereto.

16. An emergency signaling device comprising:

a. a housing made out of an acrylic plastic and having an inner surface, wherein the housing encloses and seals the device;

b. two light emitting diodes positioned within the housing and powered by a battery also within the housing, wherein each light emitting diode is capable of emitting a pulsating light; and c. a race protruding from the inner surface and partially extending around the device, such that when each light emitting diode emits the pulsating light, the light internally reflects through the race such that the light can be viewed from multiple vantage points around the device.

* * * * *